US005561253A

United States Patent [19]

Chen

[11] Patent Number: 5,561,253

[45] Date of Patent: Oct. 1, 1996

[54] MUSICAL BOX

[76] Inventor: Joseph Chen, P.O. Box 82-144, Taipei, Taiwan

[21] Appl. No.: 510,768

[22] Filed: Aug. 3, 1995

[51] Int. Cl.[6] ..... G10F 1/12; A63H 3/28

[52] U.S. Cl. ..... 84/95.2; 446/298; D17/24

[58] Field of Search ..... 84/95.1, 95.2, 84/94.1, 94.2; 446/297, 298, 303, 236, 280, 281, 282; D17/24

[56] References Cited

U.S. PATENT DOCUMENTS 4,197,778 4/1980 Komatsu et al. ..... 84/95.2
5,331,110 7/1994 Chen ..... 84/95.2

*Primary Examiner*—Cassandra C. Spyrou
*Attorney, Agent, or Firm*—Alfred Lei

[57] ABSTRACT

A musical box including a housing having two opposite side walls, a base arranged on an upper inner side of one of the side walls, a seat fixedly mounted on the base and provided with a casing in which is fitted a spiral spring, the spiral spring being connected with a control lever and a gear train, the gear train being engaged with a first gear fixedly mounted on one end of a drum provided with a plurality of protuberances thereon, a hitting member fixedly mounted on the seat and having a plurality of tines in contact with the drum, a frame having a first leg fixedly mounted on the hitting member and a second leg fixedly mounted on the seat, a second gear meshed with the first gear, a disc provided at a bottom side with a first bolt depending downwardly through the frame to engage with the second gear, the disc being provided at an upper side with a second bolt, a fork-liked member having at an upper end two prongs between which is slidably fitted the second bolt, an axle pivotally mounted across the two opposite side walls, a swing suspended on the axle, and two dolls mounted on the swing.

1 Claim, 4 Drawing Sheets

MUSICAL BOX

CROSS-REFERENCE

BACKGROUND OF THE INVENTION

1. Field of the Invention

This invention relates to a musical box with a swing.

2. Description of the Prior Art

It has been found that the conventional musical box is simply a box with a mechanical device that produces a tune when the box is opened. However, such a musical box is monotonous and too complicated in structure thereby increasing the cost thereof.

Therefore, it is an object of the present invention to provide a musical box which may obviate and mitigate the above-mentioned drawbacks.

SUMMARY OF THE INVENTION

This invention relates to a musical box.

It is the primary object of the present invention to provide a musical box which will cause a swing to move backward and forward.

It is another object of the present invention to provide a musical box which is of much fun.

It is still another object of the present invention to provide a musical box which is amusing and interesting.

It is still another object of the present invention to provide a musical box which is simple in construction.

It is a further object of the present invention to provide a musical box which is facile to manufacture.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
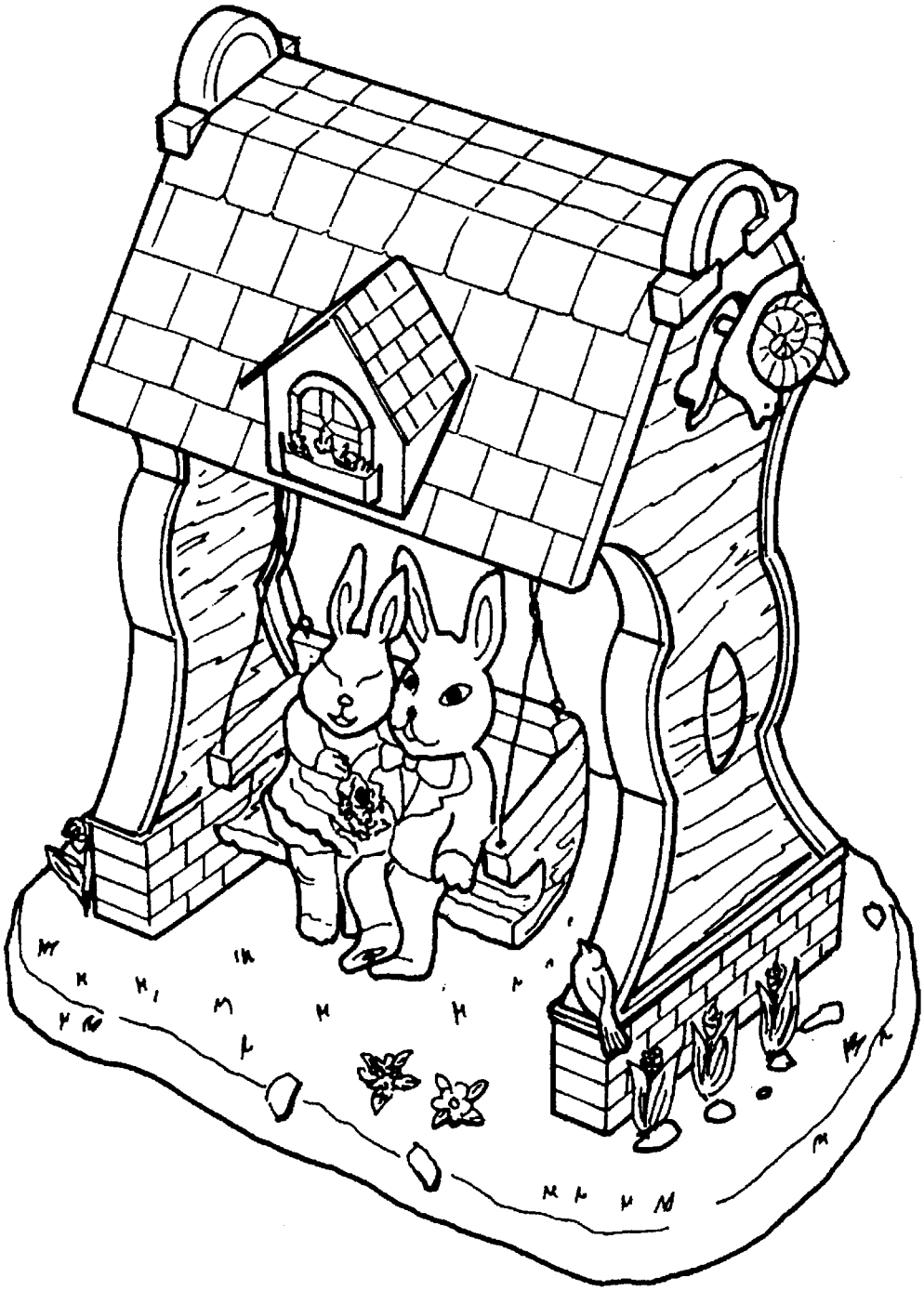
FIG. 1 is a perspective view of the present invention.

For the purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
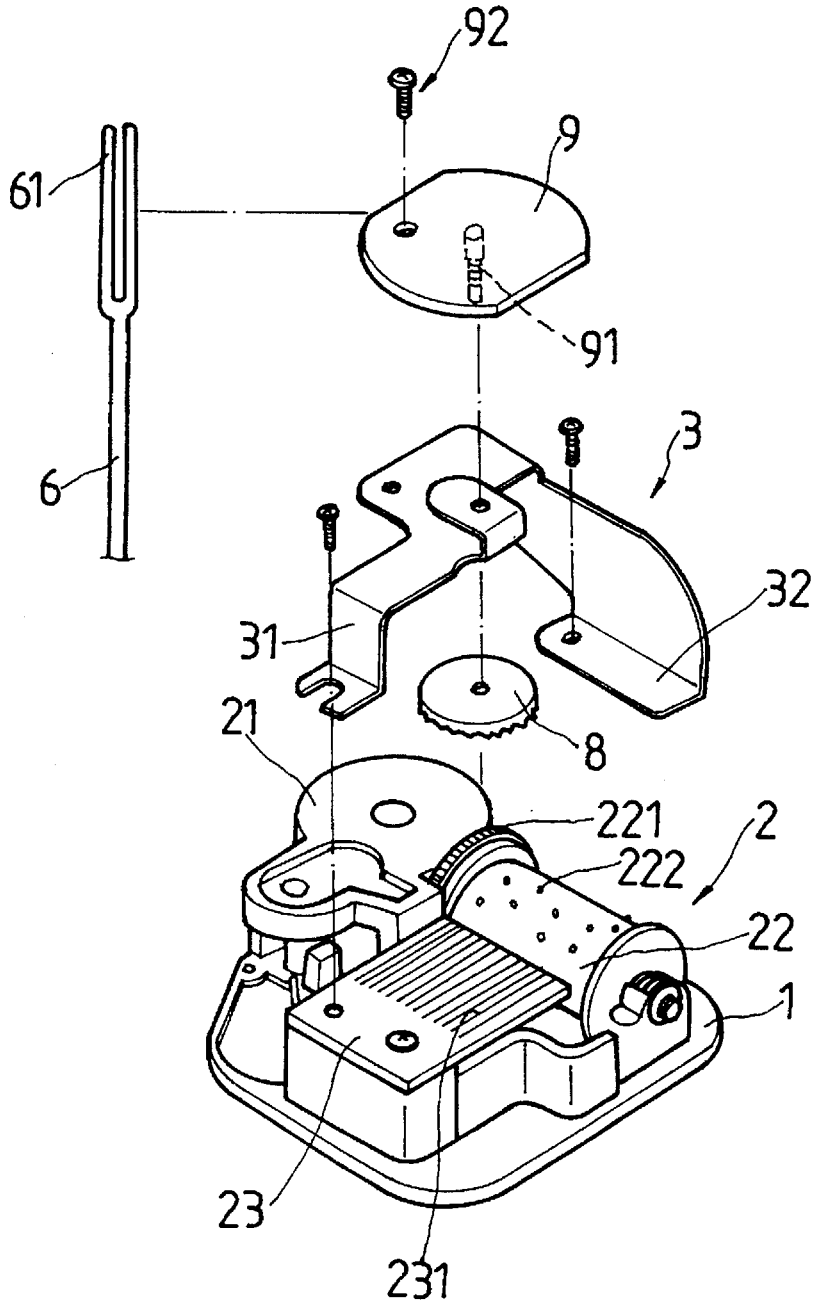
FIG. 2 is an exploded view of the present invention.
Figure 3:
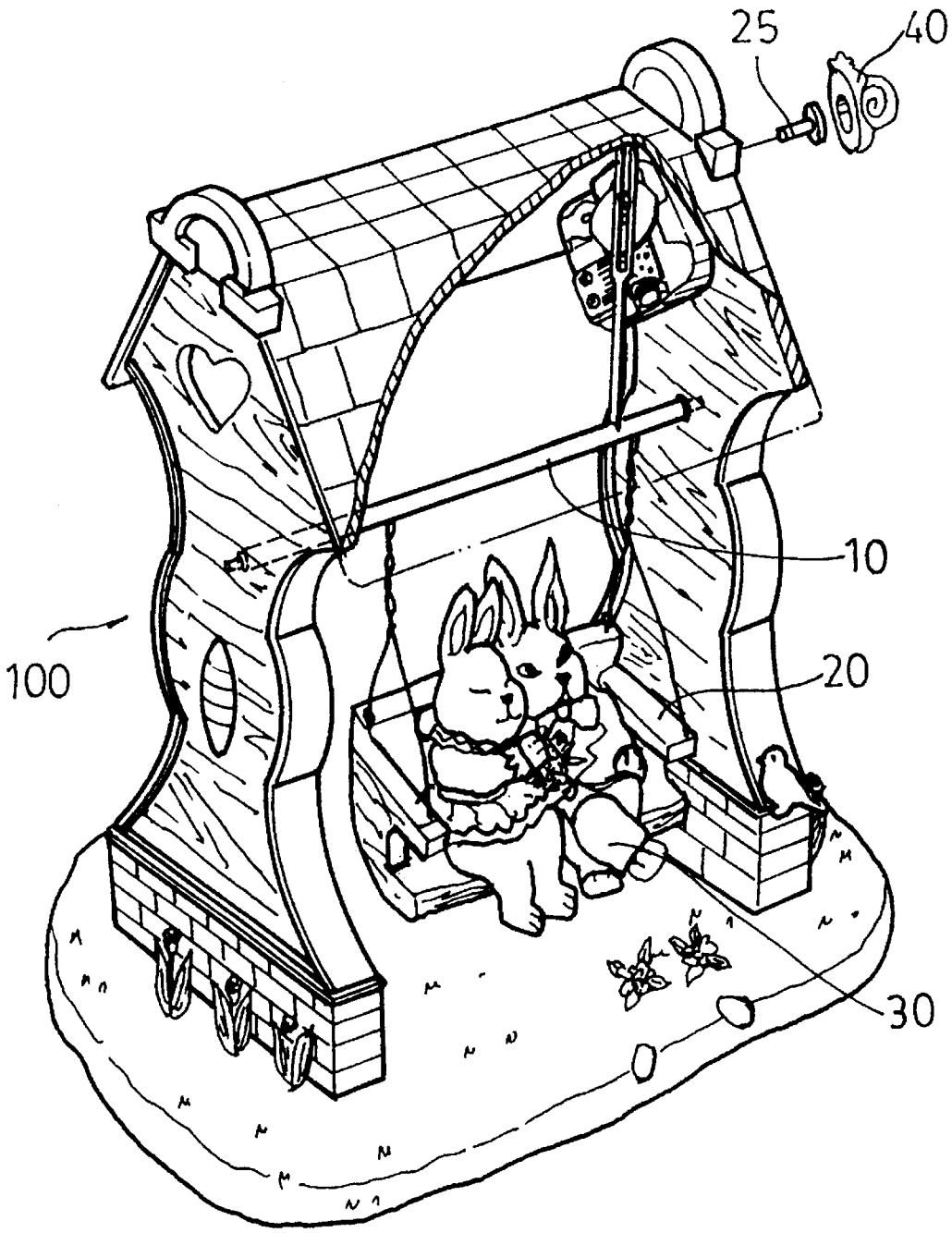
FIGS. 3 and 4 illustrate the working principle of the present invention.

With reference to the drawings and in particular to FIGS. 1, 2 and 3 thereof, the musical box according to the present invention mainly comprises a housing 100, a base 1, a seat 2, a frame 3, a gear 8, a disc 9, and a fork-liked member 6.

As illustrated, the base 1 is arranged on the upper inner portion of a wall 50 of the housing 100 (see FIG. 3). Referring to FIGS. 1 and 2, the seat 2 is fixedly mounted on the base 1 by screws (not shown). On the seat 2 are mounted a casing 21 in which is fitted a spiral spring (not shown). The spiral spring is connected with a control lever 25 (see FIG. 3) by means of which the spiral spring can be turned tight. The control lever 25 is engaged with a decorative member 40 at the outer end. The spiral spring is connected with a gear train (not shown) so that the spiral spring will drive the gear train to rotate. The gear train is in turn engaged with a gear 221 which is fixedly mounted on one end of a drum 22 formed with a plurality of protuberances 222 thereon. A hitting member 23 having a plurality of tines 231 is fixedly mounted on the seat 2, with its tines 231 contacting the surface of the drum 22.

The frame 3 is provided with a first leg 31 fixedly mounted on the hitting member 23 and a second leg.32 fixedly mounted on the seat 2. The gear 8 is meshed with the gear 221 fixedly mounted on one end of the drum 22. The disc 9 is provided with a bolt 91 depending from the lower side thereof. The bolt 91 extends downwardly through the frame 3 to engage with the gear 8 so that the disc 9 will be rotated with the gear 8. A bolt 92 is threadedly engage with the upper side of the disc 9. The fork-liked member 6 is provided with two prongs 61 at the upper end. The bolt 92 is slidably fitted between the two prongs 61 of the fork-liked member 6.

The lower end of the fork-liked member 6 is welded or otherwise secured to an axle 10 which is pivotally mounted across two opposite walls 50 of the housing 100. A swing 20 is suspended on the axle 10, on which are mounted two dolls 30.

Figure 4:
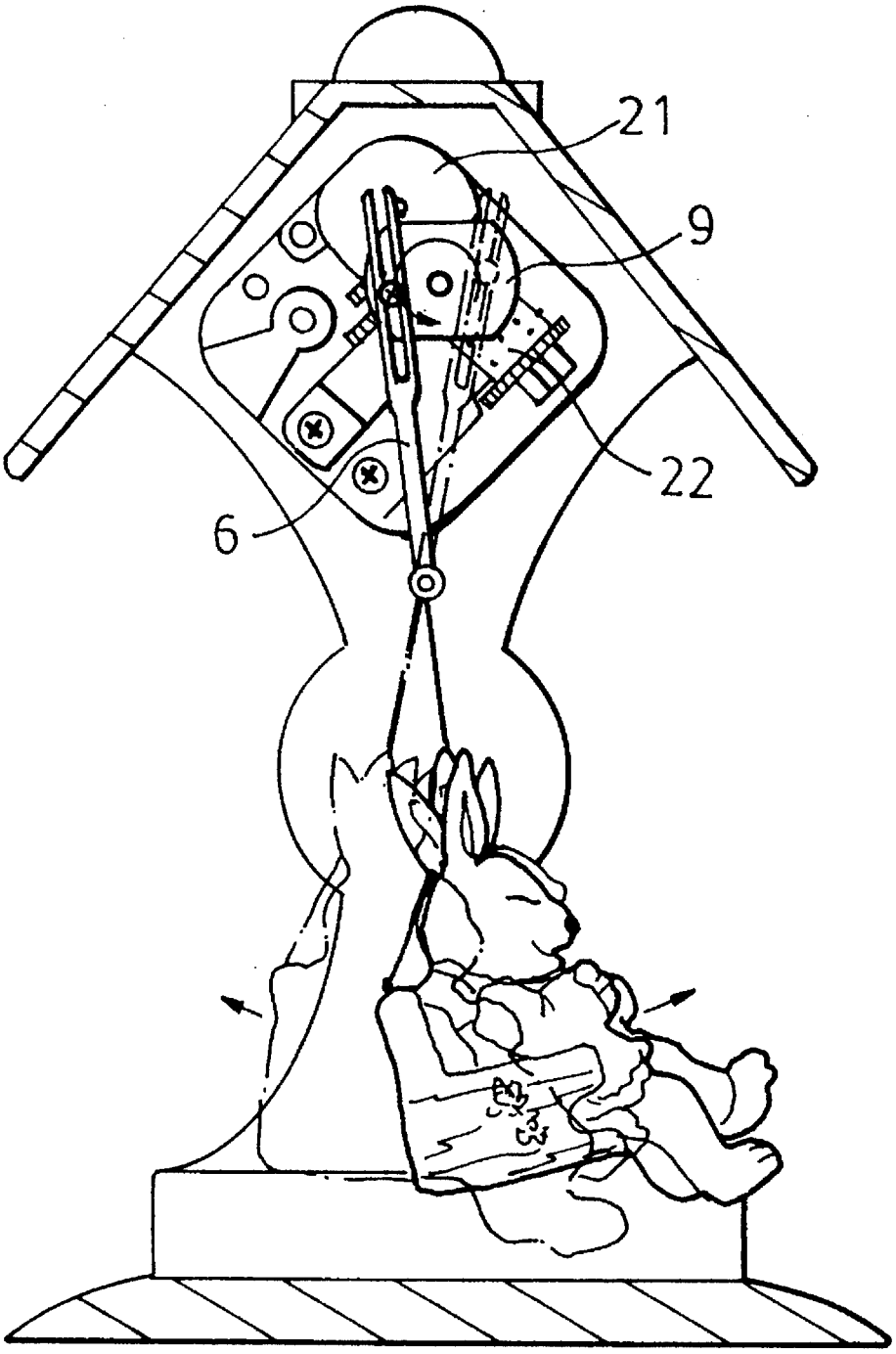

Turning now to FIGS. 2, 3 and 4, there are shown the working principle of the present invention. When desired to produce music, simply turn the control lever 25 to turn the spiral spring tight and then release the control lever 25. In the meantime, the spiral spring will drive the gear train (not shown) which will in turn drive the gear 221 thereby rotating the drum 22 and the gear 8. As the drum 22 is rotated, the tines 231 of the hitting member 23 will hit the protuberances 222 of the drum 22 hence producing music. Meanwhile, the disc 9 will be rotated with the gear 8 thereby moving the fork-liked member 6 to go backward and forward. Hence, the axle 10 will be rotated to sway the swing 20 together with the dolls 30 backward and forward.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A musical box comprising:

a housing having two opposite side walls;

a base arranged on an upper inner side of one of said side walls;

a seat fixedly mounted on said base and provided with a casing in which is fitted a spiral spring, said spiral spring being connected with;

a control lever and a gear train, said gear train being engaged with a first gear fixedly mounted on one end of a drum provided with a plurality of protuberances thereon;

a hitting member fixedly mounted on said seat and having a plurality of tines in contact with said drum;

a frame having a first leg fixedly mounted on said hitting member and a second leg fixedly mounted on said seat;

a second gear meshed with said first gear;

a disc provided at a bottom side with a first bolt depending downwardly through said frame to engage with said second gear, said disc being provided at an upper side with a second bolt;

a fork-liked member having at an upper end two prongs between which is slidably fitted said second bolt;

an axle pivotally mounted across said two opposite side walls;

a swing suspended on said axle; and two dolls mounted on said swing.

* * * * *